US009226623B2

(12) United States Patent
Geels et al.

(10) Patent No.: US 9,226,623 B2
(45) Date of Patent: Jan. 5, 2016

(54) MULTI-PIECE BATHING STRUCTURE SURROUND AND METHOD

(75) Inventors: Michael Glenn Geels, Jackson, TN (US); Dane Hyatt Carswell, Hatboro, PA (US); John Gerard Finch, Livonia, MI (US); Nirav D. Parikh, Sylvania, OH (US); Lloyd D. Doigan, Franklin, MI (US)

(73) Assignee: Delta Faucet Company, Indianapolis, IN (US)

( * ) Notice: Subject to any disclaimer, the term of this patent is extended or adjusted under 35 U.S.C. 154(b) by 665 days.

(21) Appl. No.: 13/435,856

(22) Filed: Mar. 30, 2012

(65) Prior Publication Data

US 2013/0254983 A1 Oct. 3, 2013

(51) Int. Cl.

| | |
|---|---|
| ***A47K 3/00*** | (2006.01) |
| ***A47K 3/02*** | (2006.01) |
| ***A47K 3/04*** | (2006.01) |
| ***A47K 3/30*** | (2006.01) |
| ***A47K 3/28*** | (2006.01) |
| *A47K 3/08* | (2006.01) |

(52) U.S. Cl.

CPC . *A47K 3/04* (2013.01); *A47K 3/284* (2013.01); *A47K 3/30* (2013.01); *A47K 3/08* (2013.01); *B65D 2585/644* (2013.01)

(58) Field of Classification Search

CPC ..... A47K 3/16

USPC ..... 4/595

See application file for complete search history.

(56) References Cited

U.S. PATENT DOCUMENTS

| | | | | |
|---|---|---|---|---|
| 2,313,421 | A | 3/1943 | Dalton, Jr. | |
| 2,508,969 | A | 5/1950 | Richardson | |
| 2,961,101 | A * | 11/1960 | Hutton | 211/132.1 |
| 3,038,601 | A * | 6/1962 | Storck et al. | 206/516 |
| 3,486,612 | A | 12/1969 | Kivell | |
| 3,590,392 | A | 7/1971 | Hollander | |
| 3,590,393 | A | 7/1971 | Hollander | |
| 3,783,456 | A * | 1/1974 | Doan | 4/557 |
| 3,813,844 | A | 6/1974 | Coons et al. | |
| 3,996,703 | A | 12/1976 | Daniels | |
| 3,999,658 | A | 12/1976 | Anderson | |
| 4,043,853 | A | 8/1977 | Saladino | |
| 4,541,130 | A | 9/1985 | Calvert | |
| 4,553,276 | A * | 11/1985 | Paradis | 4/612 |
| 4,578,832 | A | 4/1986 | Primucci | |
| 5,263,208 | A * | 11/1993 | Smith | 4/612 |
| 6,938,764 | B2 * | 9/2005 | Edwards et al. | 206/320 |
| 7,464,827 | B2 | 12/2008 | Meissen | |
| 8,082,608 | B2 * | 12/2011 | Dabrowski | 4/584 |
| 8,745,777 | B2 * | 6/2014 | Shteyngarts | 4/580 |
| 2006/0096880 | A1 * | 5/2006 | Zander et al. | 206/440 |
| 2010/0269252 | A1 | 10/2010 | Shteyngarts | |
| 2011/0023381 | A1 | 2/2011 | Weber | |
| 2013/0019522 | A1 * | 1/2013 | Eaton et al. | 44/322 |

* cited by examiner

*Primary Examiner* — Huyen Le
*Assistant Examiner* — Christine Skubinna
(74) *Attorney, Agent, or Firm* — Carlson, Gaskey & Olds, PC

(57) ABSTRACT

A surround includes a first piece including a basin, a second piece having a second piece back wall and a second piece side wall attaching to the second piece back wall for being disposed horizontally atop the first piece, and a third piece having a third piece back wall and a third piece side wall attaching to the third piece back wall for being disposed horizontally atop the second piece back wall and the second piece side wall, wherein the first piece, the second piece and the third piece form a package wherein one of the second piece or the third piece is disposed about the basin and an other of the second piece or the third piece nests behind the one of the second piece or the third piece.

66 Claims, 9 Drawing Sheets

MULTI-PIECE BATHING STRUCTURE SURROUND AND METHOD

The present invention relates to a bathing surround, and to a packaging and shipping arrangement therefore.

BACKGROUND OF THE INVENTION

Bathing surrounds, such as for showers or tubs, may be positioned within a recess built to receive the surround. The surround is inserted into the recess or corner to form a watertight structure. A watertight structure is highly advantageous because it minimizes the escape of water into a wall cavity behind the surround despite splashing or spraying water onto the structure's surrounding walls.

The surround may be formed as a one-piece structure, a two-piece structure formed of a one-piece U-shaped wall and a tub, or a three-piece structure that includes the tub and two L-shaped wall portions that sit atop the tub and are joined vertically to form the U-shaped walls. The contiguous wall portions fit atop the tub to provide ease of assembly while creating a water tight structure.

SUMMARY OF THE INVENTION

According to an embodiment disclosed herein, a surround includes a first piece including a basin, a second piece having a second piece back wall and a second piece side wall attaching to the second piece back wall for being disposed horizontally atop the first piece, and a third piece having a third piece back wall and a third piece side wall attaching to the third piece back wall for being disposed horizontally atop the second piece back wall and the second piece side wall. The first piece, the second piece and the third piece form a package wherein one of the second piece or the third piece is disposed about the basin and an other of the second piece or the third piece nests behind the one of the second piece or the third piece.

According to another embodiment disclosed herein, a surround has a first piece including a basin, and one or more second pieces having a second piece back wall and a second piece sidewall attaching to the second piece back wall for being disposed horizontally atop the first piece. The second piece is disposed about the basin to form a roughly rectangular package.

According to another embodiment disclosed herein, a method of packaging a surround, which includes a first piece including having a basin, a second piece having a second piece back wall and a second piece side wall attaching to the second piece back wall, a third piece having a third piece back wall and a third piece side wall attaching to the third piece back wall, the steps of placing one of the second piece or the third piece about the basin and nesting an other of the second piece or the third piece nests behind the one of the second piece or the third piece.

According to another embodiment disclosed herein, a method of assembling a packaged surround, which includes a first piece including a tub having a basin, a second piece having a second piece back wall and a second piece side wall attaching to the second piece back wall, a third piece having a third piece back wall and a third piece side wall attaching to the third piece back wall, the steps of roughing in plumbing, placing the first piece in a room in register with the plumbing, testing a tub spout for leaks by looking behind the first piece, and placing the second piece atop the first piece. It is understood by one skilled in the art that the invention may be expanded so that the pieces referenced herein may be multiple pieces in addition to three pieces.

According to another embodiment disclosed herein, a method of shipping a package includes providing a surround including a first piece including a basin, a second piece having a second piece back wall and a second piece side wall attaching to the second piece back wall, and a third piece having a third piece back wall and a third piece side wall attaching to the third piece back wall, the surround to be placed in a box. Further steps include minimizing a size of the box by placing one of the second piece or the third piece about the basin and nesting an other of the second piece or the third piece behind the one of the second piece or the third piece, and placing the nested second and third pieces and the first piece in the box.

According to another embodiment disclosed herein, a method for manufacturing a bathing surround includes creating the surround in one piece, creating a depression in the one piece, the depression having one back wall and two side walls, and cutting one of the side walls away to separate the one piece into two pieces.

According to another embodiment disclosed herein, a method for minimizing a size of a container containing a basin and a wall extending upwardly from the basin, includes manufacturing the wall and the basin in one piece, cutting the wall into a first piece and a second piece along a line parallel to a top of the basin, and nesting the second piece behind the basin.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION

Figure 1:
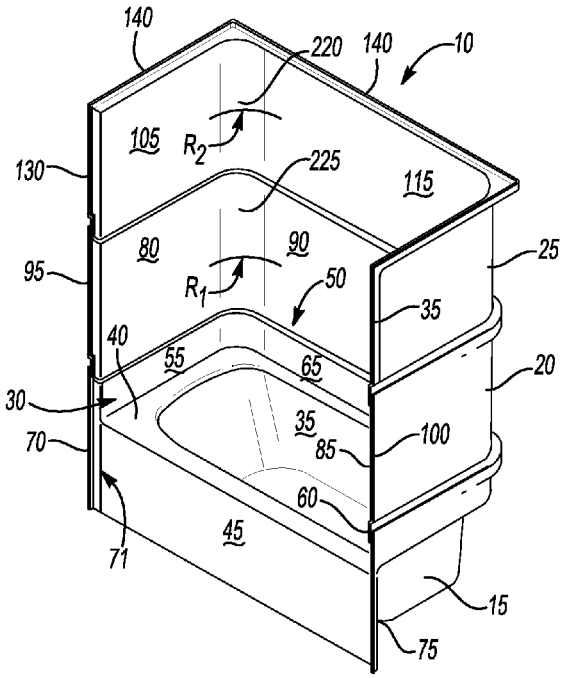
FIG. 1 is a perspective view of a surround in an assembled condition.

Referring to FIGS. 1 and 1A-C, a surround 10 is shown. The surround 10 has a first piece 15, a second piece 20 and a third piece 25. The first piece 15, second piece 20 and third piece 25 are made of a flexible plastic material such as an ABS, polyester, a polymer, a biopolymer, SMC, acrylic capped ABS or the like. The surround 10 is intended to be used in bathing environments. It is understood that the pieces may be molded on one unitary piece and then cut into multiple pieces, or in multiple pieces as described herein.

The first piece 15 includes a tub 30 that includes a basin 35, a ledge 40 extending around the basin 35, a skirt 45 extending downwardly from the ledge 40 and a backsplash 50. The backsplash has a left lower sidewall 55, a right lower sidewall 60 and a back lower sidewall 65 connecting the right lower sidewall 60, and the left lower sidewall 55. A left lower nailing flange 70 extends along a left side 71 of the skirt 45. A right lower nailing flange 75 extends up the right side 77 of the skirt 45. The tub basin 35 is disposed away from the left lower sidewall 55, the right lower sidewall 60 and the back lower sidewall 65 by the width(s) of the ledge 40, thereby creating an area behind and alongside of the basin 35 for stacking the second piece 20 and the third piece 25 therein as will be discussed infra. A lower top nailing flange 79 extends around the tops of the left lower sidewall 55, the right lower sidewall 60, and the back lower sidewall 65 for nailing to a structure (not shown). Alternatively, the first piece 15 may not have a backsplash 50 as the second piece may nest atop the skirt 45 or the basin 35 herein.

The second piece 20, which is disposed atop the first piece 15, has a left intermediate sidewall 80, a right intermediate sidewall 85, and a back intermediate sidewall 90 connecting left intermediate sidewall 80 and right intermediate sidewall 85. The left intermediate sidewall has a nailing flange 95 extending from the left intermediate sidewall 80 and a right intermediate nailing flange 100 extending from the right intermediate sidewall 85. An intermediate top nailing flange 103 extends around the tops of the left intermediate sidewall 80, the right intermediate sidewall 85, and the back intermediate sidewall 90 for nailing to a structure (not shown).

The third piece 25, which is disposed atop the second piece 20, includes a left upper sidewall 105, a right upper sidewall 110, a back upper sidewall 115 connecting the left upper sidewall 105 and the right upper sidewall 110. The third piece has a left nailing flange 130 extending from the left upper sidewall 105 and a right nailing flange 135 extending from the right upper sidewall 110. A top upper nailing flange 140 extends around the tops of the left upper sidewall 105, the right upper sidewall 110, and the back upper sidewall 125 for nailing to a structure (not shown).

Figure 1A:
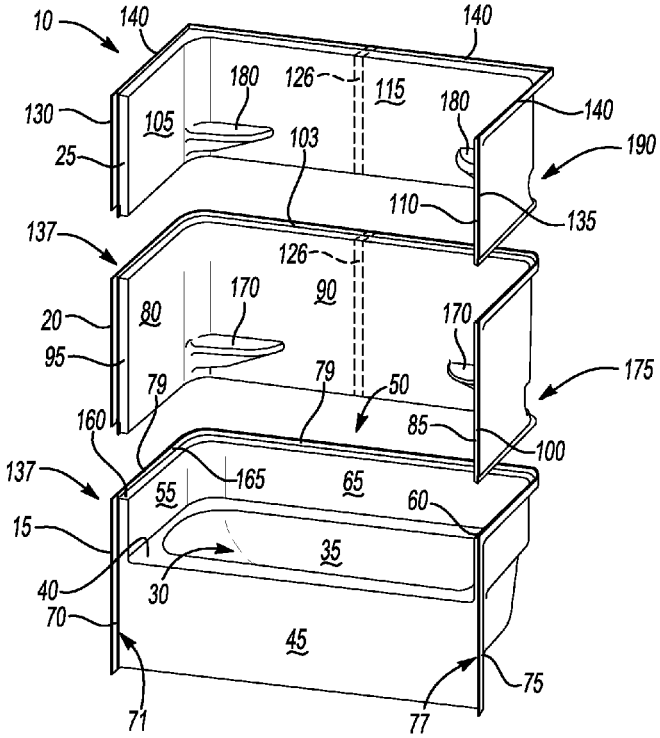
FIG. 1A is an exploded view of an embodiment of the surround of FIG. 1.
Figure 1B:
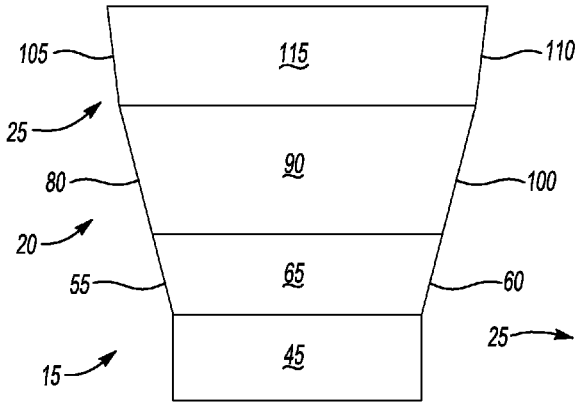
FIG. 1B is an exaggerated, schematic, front view of an embodiment of the surround of FIG. 1.
Figure 1C:
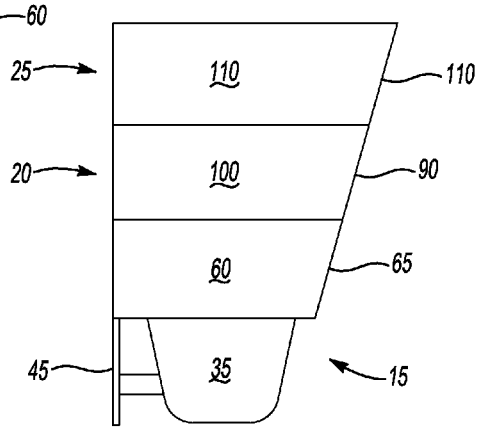
FIG. 1C is an exaggerated, schematic, side view of an embodiment of the surround of FIG. 1.

Referring specifically to FIGS. 1B and 1C, which are exaggerated for ease of illustration, it is seen that the left upper sidewall 105, the right upper sidewall 110, and the back upper sidewall 115 angle slightly inwardly towards the skirt 45 and the basin 35 from a top of the surround 10. Similarly, the left intermediate sidewall 80, the right intermediate sidewall 85, and the back intermediate sidewall 90 of the second piece 20 angle slightly inwardly towards the skirt 45 and the basin 35 from a top of the surround 10. Also the left lower sidewall 55, the right lower sidewall 60 and the back lower sidewall 65 connecting the right lower sidewall 60, and the left lower sidewall 55 of the backsplash angle slightly inwardly towards the skirt 45 and the basin 35 from a top of the surround 10. This slight angle, which gives the pieces a trapezoidal shape, provides a nesting space for the third piece 25 to nest about the second piece 20 and the third and second piece 25, 20 about the first piece 15.

As an alternative and referring back to FIG. 1, the left upper sidewall 105, the right upper sidewall 110, and the back upper sidewall 115 of the third piece 25 do not angle inwardly towards the skirt 45 and the basin 35 from a top of the surround 10. The left upper sidewall 105, the right upper sidewall 110, and the back upper sidewall 115 remain vertical but the corner 220 is pushed in, along with the left upper sidewall 105, the right upper sidewall 110, and the back upper sidewall 115, along its vertical length towards the basin 35 from the outer periphery of the surround 10. The corner 225, along with the left intermediate sidewall 80, the right intermediate sidewall 85, and the back intermediate sidewall 90 of the second piece 20, may then fit around the corner 220 and walls 110, 115, and 120 of the third piece 25. As a further alternative, the corner 225 of the second piece 20 may be pushed in, the sides 80, 85, 90 remain vertical, and the third piece 25 may enclose the second piece 20. In essence, one of the second piece 20 or the third piece 25 is smaller than the other in certain dimensions so that the larger piece may fit around the smaller piece, both of which may fit around the basin 35. The pieces are also flexible to allow the sides thereof to flex about the other or the basin 35.

Figure 1D:
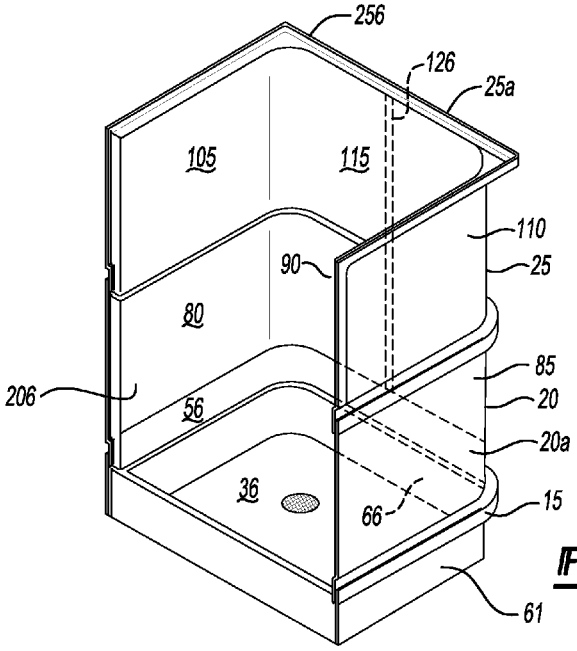
FIG. 1D is a perspective view of a surround for a shower made according to the teachings herein.

Referring to FIG. 1D, the surround 10 may have a first piece 15 that has a basin 36 (or small tub such as a soaking or walk-in tub) for a shower (i.e., not for a tub) having upwardly extending walls 56, 61 66. The first piece 15 may not have upwardly extending walls 56, 61 66, as the second piece 20 may nest atop the basin herein.

Figure 2:
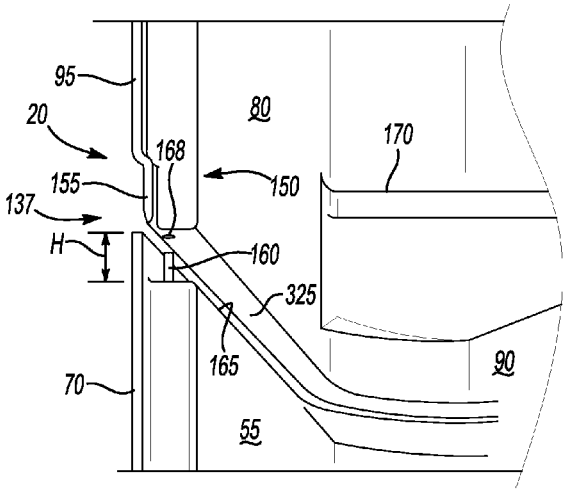
FIG. 2 is a perspective view, partially in section, of joinery between segments of the surround of FIG. 1A.
Figure 2A:
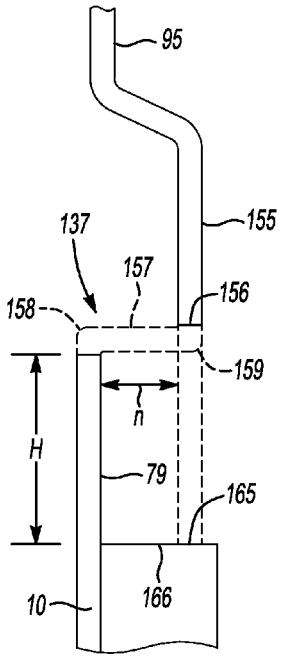
FIG. 2A is a side view, partially in phantom of joinery shown in FIG. 2.

Referring now FIGS. 1A, 2, and 2A, there are interfaces 137 between the first piece 15 and the second piece 20, and the second piece 20 and the third piece 25 to construct the surround 10. FIG. 2 shows an interface 137 between the first piece 15 and the second piece 20. The second piece 20 has a bottom intermediate wall 150 that extends around the bottom of the left intermediate sidewall 80, the right intermediate sidewall 85, and the back intermediate sidewall 90. The bottom intermediate wall 150 has an indented surface 155 extending there-round and is about the height H of the nailing flange 79 so that the indented surface 155 mates face-to-face within the nailing flange 79 and an end 156 of the indented surface 155 sits atop the top 165 of the lower left side wall 55. The left nailing flange 95 of the left intermediate sidewall is aligned with the left nailing flange 70 of the left lower side wall 55, (and the right nail flange 75 and the right nail flange 100 are aligned) to give a visual effect of a vertical straight line.

During manufacture of the surround 10 in which the pieces 15, 20 and 25 of thereof are made as one piece, a horizontal piece 157 connects the indented back piece 155 and the nailing flange 79. During assembly, a blade 315 (see also FIG. 9) cuts the horizontal piece 157 away without damaging hole 168, including connecting radii 158 and 159 so that the indented piece 155 can seat firmly on the top 165 of the first piece. A similar horizontal piece (not shown) also connects the second piece 20 to the third piece 25. FIG. 2A is exaggerated to show detail. In reality, the arrow A indicates that the distance between indented piece 155 and the nailing flange 79 is minimized to allow the indented piece 155 and the nailing flange 79 to touch or be minimized to minimize water behind the indented piece 155.

Figure 9:
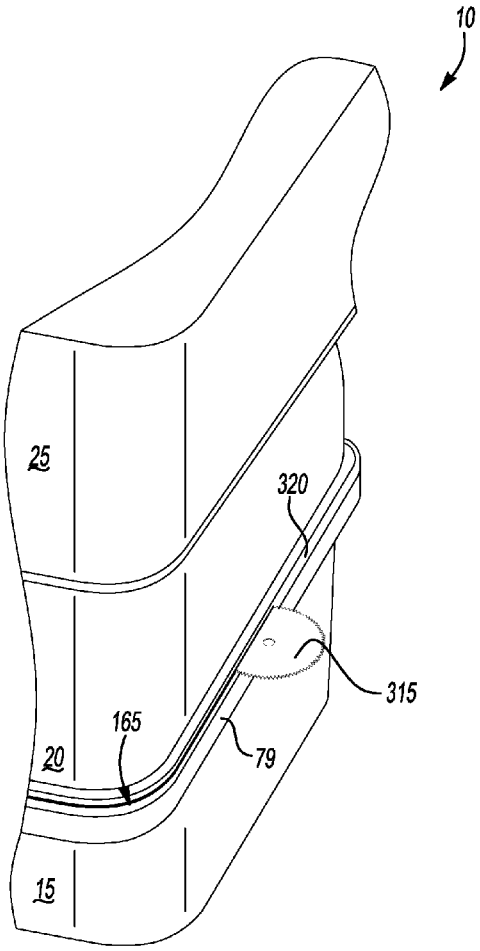
FIG. 9 shows a one piece surround as shown in FIG. 1 being separated.

Referring back to FIGS. 1A and 1D, the second and/or third pieces 20, 25 may have a vertical depression 126 to allow the second and/or third pieces to be separated vertically as opposed to horizontally as shown in FIGS. 2A and 9. By separating the pieces vertically, there are more options to pack the surround in smaller packages. In 1D, for instance the parts may be separated into 25*a*, 25*b*, 20*a* and 20*b* as will be discussed infra.

A peg 160 extends from the top 165 of the lower left side wall 55 and is for seating in hole 168 disposed on the bottom 167 of the intermediate left side wall 80 to locate the first piece 15 to the second piece 20 during installation thereof. One of ordinary skill in the art would recognize that there are be other ways to attach and align the second piece to the first piece, and the third piece to the second piece 20. For instance, the peg 160 may be replaced by a centering cone or a shaped projection that fits in a recess in the adjacent piece. Holes are automatically drilled in the adjacent pieces both to place the peg 160, which may be a glued-in nylon shutter peg, and to seat the peg. The holes 166, 168 are automatically drilled to ensure the holes 166, 168 and the pieces 15, 20, 25 are in register and aligned with each other. Because the surround 10 is made of one piece it is relatively easy to align the holes. One of ordinary skill in the art will recognize that the surround 10 may be made of separate pieces but alignment of the separate pieces may be more difficult and may make installation more difficult for a do-it-yourselfer where a separately made surround may require routing and burring to make the pieces fit together.

The top 165 of the lower left side wall 55 is angled downwardly at an angle greater than 2° from horizontal from the nailing flange 79 towards the basin 35 so that if any water gets between the first piece 15 and the second piece 20, the water will tend to migrate towards the basin 35 for removal from the surround 10.

Intermediate shelves 170 are placed on the intermediate sidewall 80 and the back intermediate sidewall 90 and the right intermediate sidewall 85 of the second piece 20. These intermediate shelves 170 are indented into the material of the second piece (see also FIG. 4) and leave an intermediate recess 175 (FIG. 1A) therein. Similarly, upper shelves 180 are indented into the left upper sidewall 105 and the back upper sidewall 115, and the right upper sidewall 110. As with the intermediate shelves 170, the upper shelves 180 each have an upper recess 190 as will be discussed infra. The intermediate recess 175 has greater dimensions than the upper recess 190 to allow upper shelves 180 to fit therein as will be discussed infra. The greater dimensions are at least greater than a thickness of material forming the second and third pieces.

Figure 3:
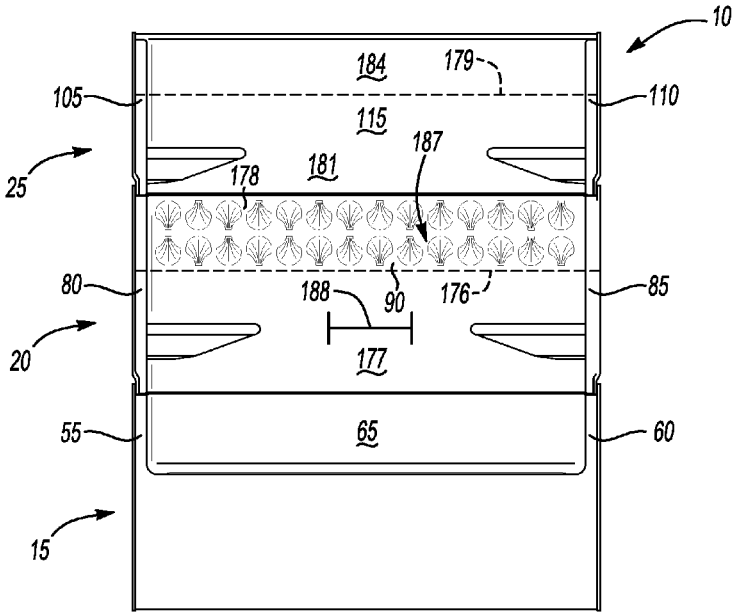
FIG. 3 is an assembled view of an embodiment of the surround of FIG. 1A.

FIG. 3 shows an assembled surround 10, having the second piece 20 arranged atop the first piece 15 and the third piece 25 arranged atop the second piece 20. As an alternative embodiment the surround may also be cut along other horizontal lines, such as but not limited to cut-line 176 in the second piece 20 thereby creating pieces 177 and 178 and cut-line 179 in the third piece 25 creating additional pieces 181 and 184. Additional cuts may allow the surround 10 to be packed even more compactly because more than two pieces may be nested behind the tub 30. In a still further embodiment, any of the pieces 15, 20, 25, 36 or 176, 177, 181, 184, may have different decorations 187 or features, like a grab bar 188, that a consumer may pick at a store before a surround 10 is created to create a desired function or design. Alternatively, a store may stock alternative pieces for a consumer to purchase for replacement.

Figure 4:
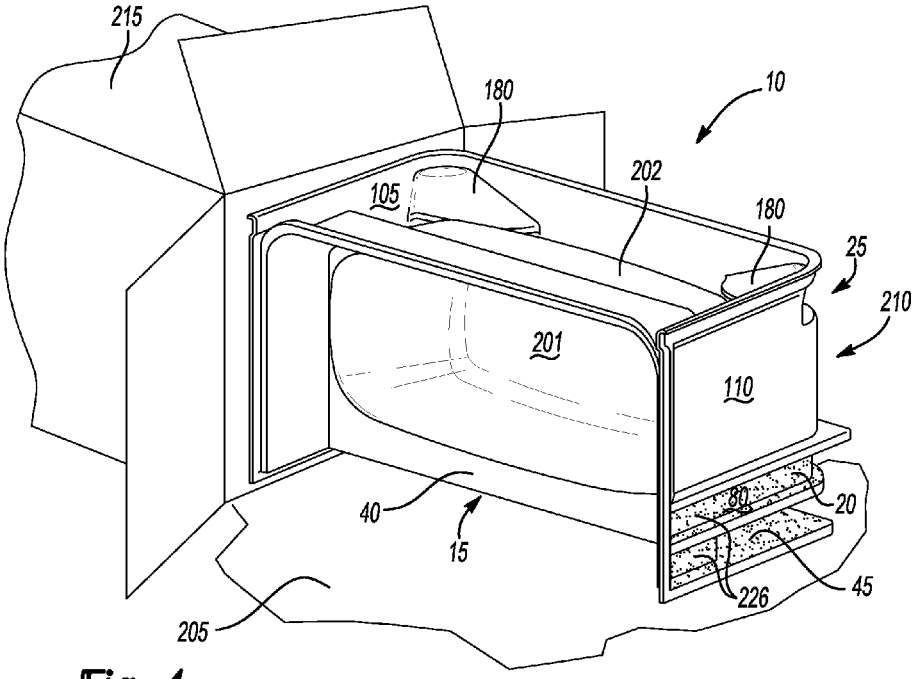
FIG. 4 shows a view of the disassembled surround of FIG. 3 ready for packaging.
Figure 5:
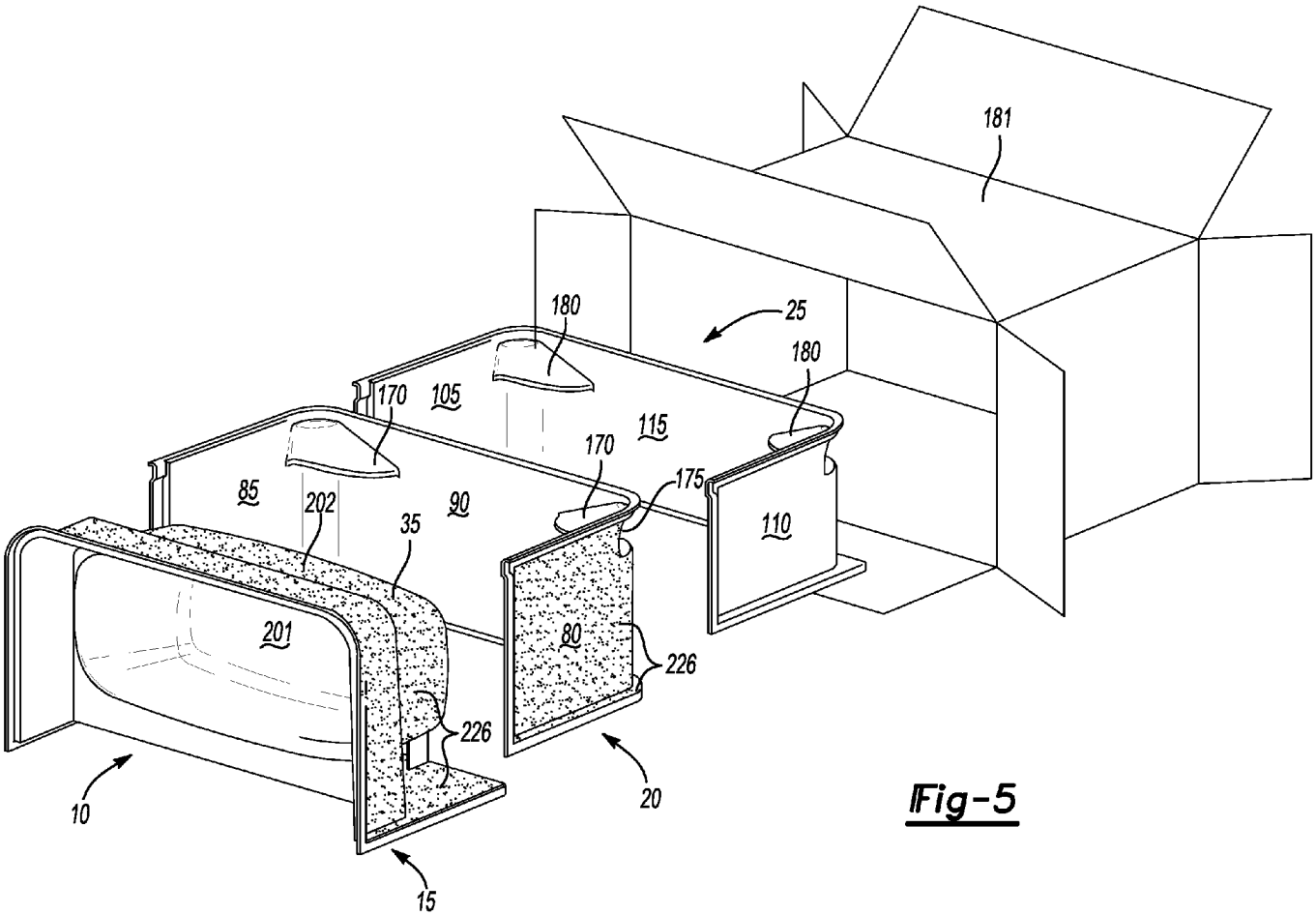
FIG. 5 shows an exploded view of the disassembled surround of FIG. 4 prior to packaging.

Referring now to FIGS. 4 and 5, a process for packing the surround 10 in an efficient manner is shown. Though the geometry of an assembly is described from a particular perspective, one of ordinary skill in the art will recognize that these pieces may be assembled from and in different positions. For example, in the instant embodiment, the first piece 15 is disposed vertically with its skirt 45 being placed upon the ground 205. The second piece 20 is aligned relative to the first piece 15 such that the nailing flanges 95 and 100 abut the back of the skirt 45 and the intermediate shelves 170 will be disposed above or in back of the basin 35. The basin 35 has a bottom 201 that fits between the left intermediate sidewall 80, and the right intermediate sidewall 85 of the second piece 20. As shown in FIG. 4, the second piece 20 is then slid in position, upside down so its top 165 now faces the ground, onto the first piece 15 such that the left intermediary sidewall abuts the back of the right lower sidewall 60 and the right intermediate sidewall abuts the back of the left lower sidewall 55. In the instant example shown, the nailing flange 140 does not touch the bottom of the ledge 40 because the intermediate shelves 170 are disposed atop the tub 30. One of ordinary skill in the art will recognize from the teachings herein that the second piece 20 may be placed on the side 202 of the basin 35 and not the bottom 201 thereof. One of ordinary skill in the art will also recognize that the second and third pieces 20 and 25 need not be flipped depending on the dimensions of the appurtenances thereto.

The shelves 170, 180 shown may be other decorations placed in areas that are not filled behind the basin bottom 201 or side 202. For instance the shelf 170 may be a decoration or a grab bar. Further each of the second piece 20 and the third piece 25 may have protruding decorative surfaces (like the shelving 170, 180) that fit within each other during packing. Also, the second or third pieces may be of varying dimensions to provide access to studs (between the first portion 15 and third portion 25, for instance) to allow grab bars (not shown) to be attached to studs.

Figure 10A:
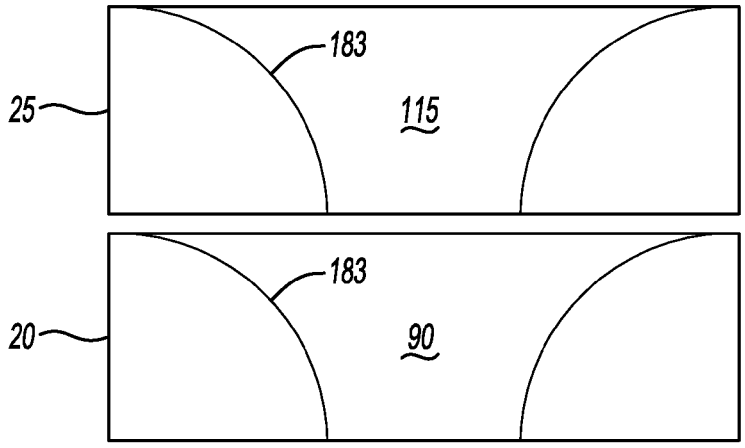
FIG. 10A shows a decorative back panel for use in the surround shown in FIG. 1.
Figure 10B:
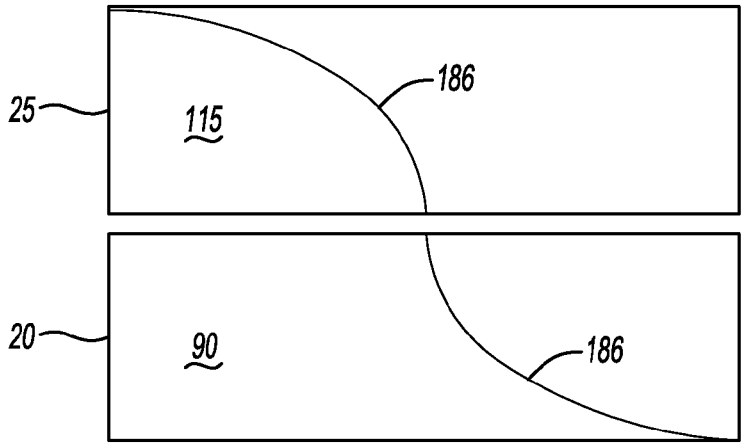
FIG. 10B shows a second decorative back panel for use in the surround shown in FIG. 1.

Referring to FIGS. 10A and 10B, one can see in 10A that if the third and second pieces 25, 20 are not flipped or are both flipped for installation, the decorative indentations 183 nest behind each other. If one of the second piece 20 or third piece 25 is to be flipped relative to the each other, the pieces have mating decorative indentations 186 as shown in FIG. 10B.

Similarly, the third piece 25 is also turned upside down as was the second piece 20. The left upper sidewall 105 is slid over the left intermediate sidewall 80 and the right upper sidewall 110 is slid over the right intermediate sidewall 85. The back of the upper shelves 180 slide behind and within the larger intermediate indent 175 in the intermediate shelves 170 to create a compact package 210 as shown in FIG. 4. The dimensions of the second and third piece may be roughly equal so that the second piece can slide over the first piece and the second piece can slide over the third piece by flexing or because of their trapezoidal shape as detailed herein supra or because the corner 225 is pushed in as detailed herein supra. One of ordinary skill in the art will recognize that the third piece 25 may have a slightly larger, longer back upside 125 than the back intermediate sidewall 90 to allow the nesting of the third piece on the second piece easier than flexing. In addition, the third piece 25 may have rounded connecting corners 220 (see FIG. 1) that have a larger radius $R_2$ than rounded connecting corners 225 (see FIG. 1) that have a radius $R_1$ so that it is relatively easy to surround the second piece 20 with the third piece 25 as shown in FIGS. 4-7. A protective layer 226 that also may include foam or other spacer blocks may be placed between the pieces 15, 20 and 25 to minimize chafing and other damage during shipping. The protective layer may be pre-glued or otherwise attached to the first piece 15, the second piece 20 or the third piece 25 to speed a packing process and minimize damage to the parts.

Figure 6:
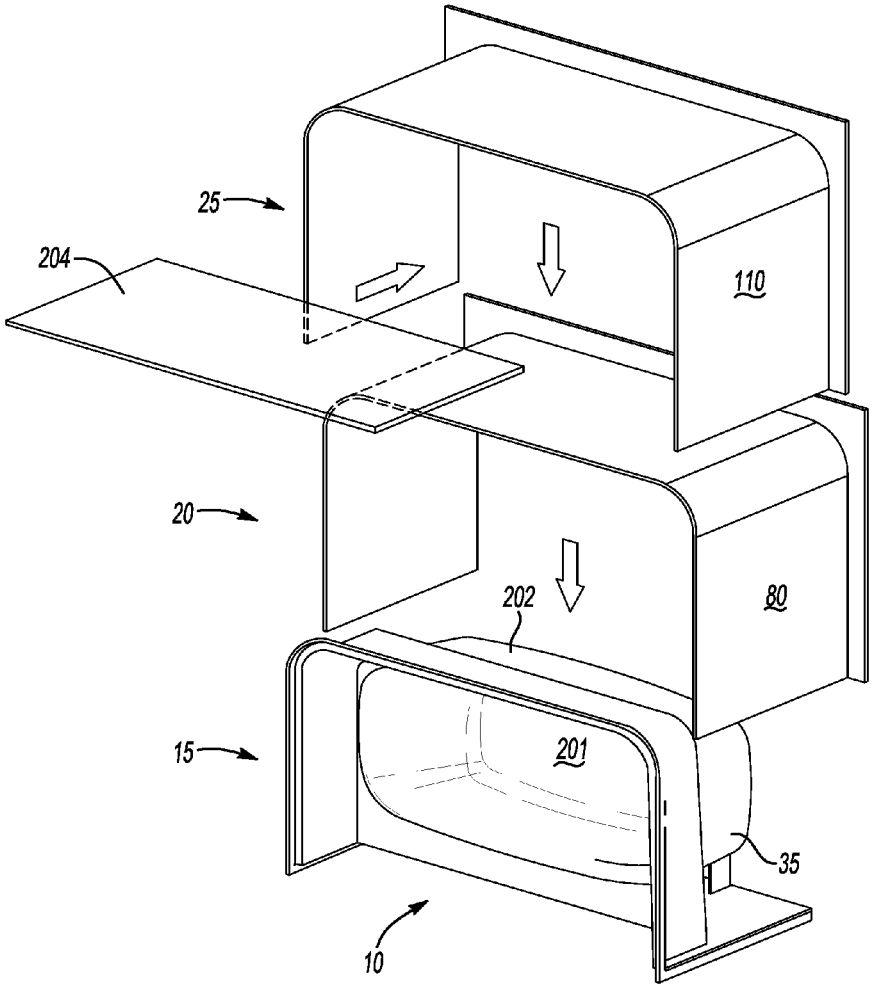
FIG. 6 shows another exploded view of the disassembled surround of FIG. 4 prior to packaging.

One of ordinary skill in the art will recognize from the teachings herein that if the surround 10 has no shelves, the second piece 20 and the third piece 25 may be mounted in differing ways about the basin 35 as long as the second and third pieces 20, 25 nest with each other. Referring to FIG. 6 for instance, if there are no shelves 170, 180, or the shelves are of appropriate size or if the shelves are in register with the basin, the second piece 20 may be nested over the side 202 of the basin 35 and the third piece 25 is then nested over the second piece 20 for shipping. Similarly, if the surround 10 has no skirt 45, the second piece 20 may wrap around the front of the basin 35 and the third piece 25 may nest over the second piece 20. One may also choose to interleave another accessory 204, such as a shower door, a decorative panel, a grab bar assembly, a shower rod or the like, between the pieces or adjacent to them during packing.

In viewing FIGS. 5 and 6, one can see that the parts are disposed in a box 191 in order of their installation. The first piece 15 may be slid out first, followed by the second piece 20 and the third piece 25. The protective layer 226 may also be slippery, e.g., made of polytetrafluoroethylene or the like, to aid a user is sliding the pieces out of the box 191. Alternatively, the box 191 may be packed so that the parts may enter one side 192 of the box and exit through flaps 193 on the other side of the box 194.

Figure 7A:
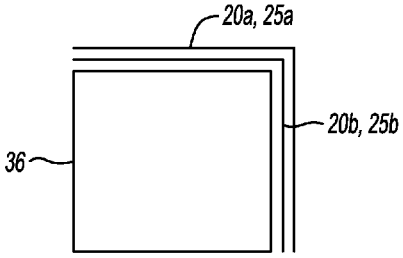
FIG. 7A shows a top view of a disassembled surround of FIG. 1D prior to packaging.
Figure 7B:
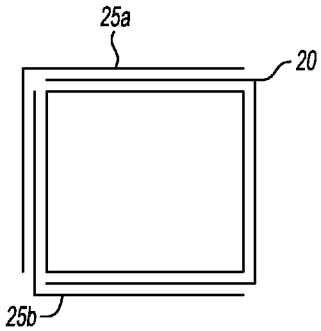
FIG. 7B shows another top view of a disassembled surround of FIG. 1D prior to packaging.
Figure 7C:
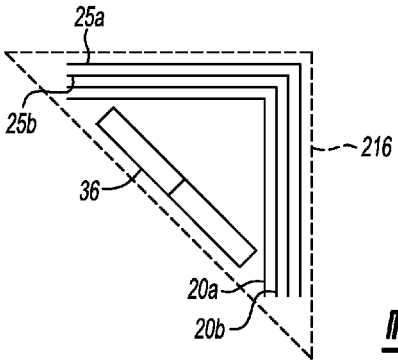
FIG. 7C shows a another top view of a disassembled surround of FIG. 1D prior to packaging.
Figure 7:
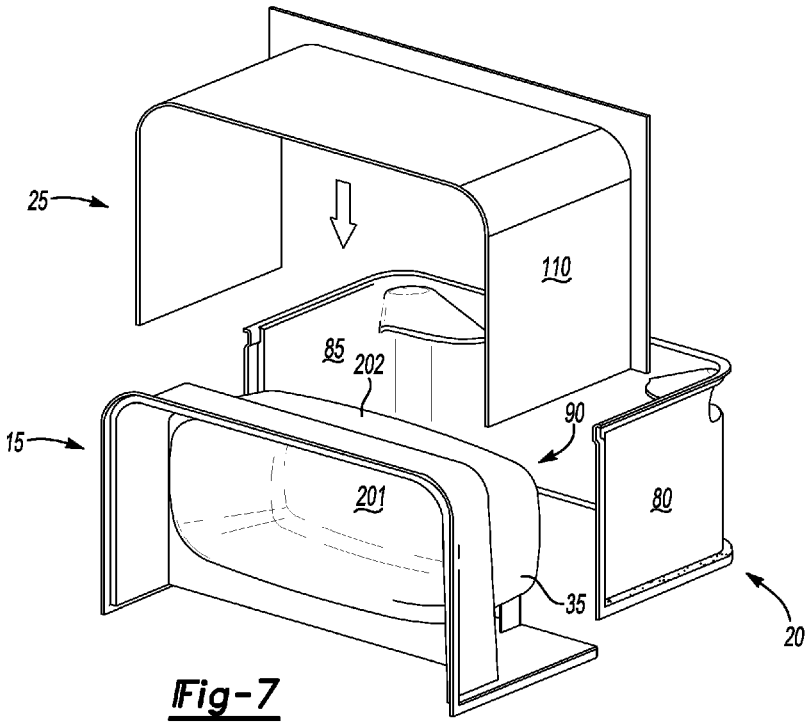
FIG. 7 shows another exploded view of the disassembled surround of FIG. 4 prior to packaging.

Referring to FIG. 7, back intermediate sidewall 90 of piece 20 is aligned at the bottom of the basin 35 and piece 25 is placed over the side 202 of the basin 35 with right upper sidewall 110 extending over left intermediate sidewall 80 with piece 25 essentially normal to piece 20. One problem with products of this type is that of transporting and handling the surround. Transportation may be particularly difficult for a homeowner who desires to install the surround as a home improvement project. The tub and wall surround are relatively large products that are assembled for transportation. The size of an assembled unit makes it difficult to transport in an automobile such as a Sport Utility Vehicle or minivan. A consumer may therefore be dissuaded from purchasing a tub and wall surround as a "do-it-yourself" home improvement project.

The package is placed into a box 215 that may fit in a passenger vehicle such as a minivan (not shown). This package 215 is also far more efficient in using space than the old packages that had to fit an assembled surround 10 as shown in FIGS. 1 and 3 and may allow many more boxes 215 to be transported to a retailer in a container, such as a truck (not shown) than previously were possible.

Referring to FIGS. 7A-7C, more packing embodiments are shown. In FIG. 7A, side 25*a* is stacked atop side 20*a* and side 25*b* is atop side 20*b*. The stacks surround two sides of the basin 36. In FIG. 7B, only piece 25 is cut vertically. Second piece 20 encloses three sides of the basin 36, side 25*a* encloses two sides of basin 36 and side 25*b* encloses two sides of the basin 36. In the instant embodiment shown, Side 25*a* encloses one side of side 25*b* though such enclosure is not necessary if it enlarges the size of an overall package. In FIG. 7C, all of the sides 20*a*, 20*b*, 25*a*, and 25*b* interleave about basin 36 which is tipped upwardly on its side to create a triangular package 216.

Figure 8:
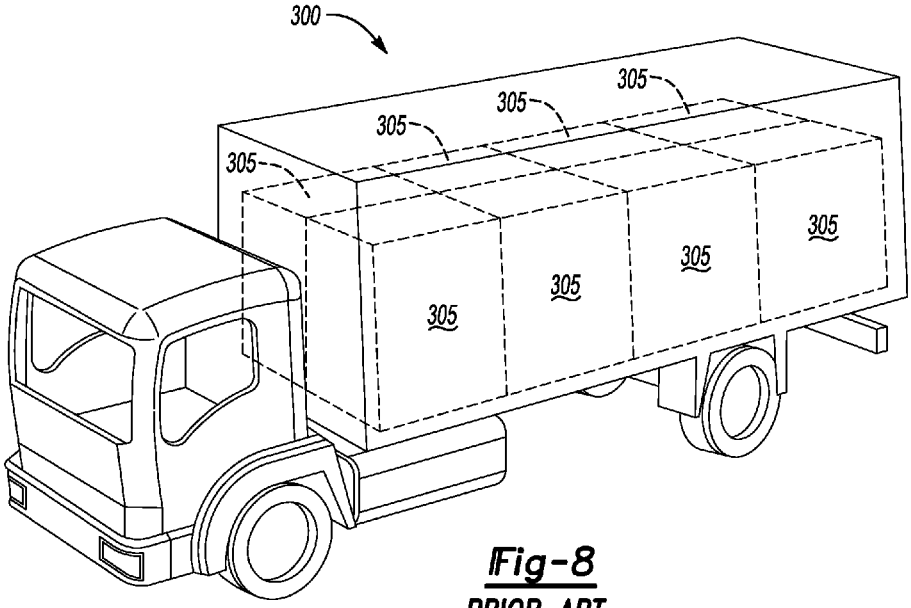
Fig-8 PRIOR ART
FIG. 8 shows a prior art, schematic view of a semi loaded with one-piece surrounds; and, FIG. 8A shows a schematic view of a semi loaded with nested and boxed three-piece surrounds of FIG. 4.
Figure 8A:
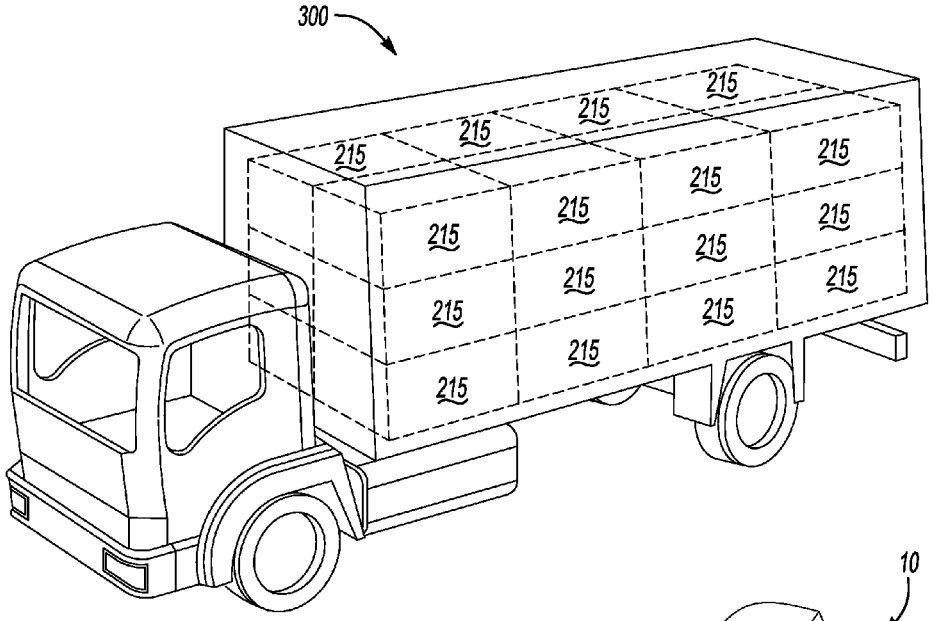

Referring to FIGS. 8 and 8A, a typical semi 300 shown in FIG. 7 could hold 41 boxes 305 (prior art, shown schematically) holding a one-piece shower in a dimensionally related box 310. On the other hand, by nesting the second piece 20 and the third piece 25 about the first piece 15 in boxes 215, now 81 boxes may be placed on the trailer thereby cutting shipping costs almost in half. A box 215 may have a dimension of 34"W×34"H×64"L, or about 73,984 cubic inches, as opposed to a box 305 which typically has a dimension of 34"W×68"H×64"L, or about 147,968 cubic inches, which provides a volume reduction of about 50%. As seen, these prior art units are extremely space intensive making it both expensive to ship from the factory and difficult to handle at plumbing wholesale and retail sales sites. In addition, retailers particularly, have difficulties dedicating sufficient bin space thereby limiting the retailer's ability to maintain and sell adequate stock. By wrapping the wall pieces 20 and 25 around the basin 35, space needed to pack the package 210 and to sell it is minimized. By minimizing bin space, more styles of surrounds 10 may also be sold.

To assemble the tub, basic plumbing including a tub spout, a tub/shower control and a shower spout (not shown—need drawing) is put in place. The first piece 15 is put in place and the nailing flanges 70, 75 and 79 are attached to studs (not shown). A hole is drilled to place a tub spout. The second piece 20 is located above and placed upon the first piece after a hole(s) have been drilled to allow a tub/shower control to extend through the hole(s) into a tub area. An installer may then test the plumbing connections between water pipes and the tub spout, the tub/shower control and the shower spout by looking behind the second piece without worrying about soaking the surrounding area. After the connections have been verified and the peg 160 is placed in the hole 166, the nailing flanges 103, 95 and 100 are attached to studs (not shown). The third piece 25 is then placed atop the second piece 20 and nailing flanges 130, 135, 140 are attached to studs (not shown). Grout or caulk then may be inserted in gaps 200 between the first piece 15 and the second piece 20 and the second piece 20 and the third piece 25 to insure a water tight seal.

Referring now to FIG. 9, a back 330 of the surround 10 is shown. The first, second and third pieces, 15, 20, 25 are molded in one piece with the pieces separated by a distance H that corresponds to the height H of the nailing flange 79. A blade 315 located outside of the surround 10 separates the pieces (in this case 15 and 20) at a corner 320 to separate the pieces thereby creating the nailing flange 79 and a bottom edge 325 of piece 20 (see FIG. 2) that sits on the top 165 of piece 15. The distance H of the nailing flange 79 is about 2.5 inches and the width of the bottom edge of piece 20 and the top 165 of piece 15 is about 1.25 inches so the ratio between the length of the flange 79 to the width of the top 165 or the width of the bottom edge 325 is up to 2:1. This ratio ensures that any draw of the material into a mold (not shown) does not stretch the material of the surround 10 too thin. By cutting the surround, the need to use burring and routing tools (not shown) to get the pieces to fit is minimized.

To manufacture the surround, the first, second and third pieces 15, 20, 25 are molded as one piece. While in the mold, the first and second and the second and third pieces are attached by nailing flange 79. After ejection from the mold, an angled blade 315 cuts the corner 320 between nailing flange 79 on the first piece 15 and the bottom 325 of the second piece 20. This angled cut allows the bottom 325 to drop onto the top 165 of the first piece 15 while allowing the flange 79, which allows attachment to studs (not shown) and provides a dam for any water that enters a joint between the first and second pieces or the second and third pieces after assembly after shipping.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A surround, the surround comprising:

a first piece including a basin, a second piece having a second piece back wall and a second piece side wall attaching to said second piece back wall at a second piece corner, said second piece configured to be disposed horizontally atop said first piece, a third piece having a third piece back wall and a third piece side wall attaching to said third piece back wall at a third piece corner, said third piece configured to be disposed horizontally atop said second piece back wall and said second piece side wall, wherein said first piece, said second piece and said third piece form a package wherein one of said second piece or said third piece is disposed about said basin and another of said second piece or said third piece nests behind said one of said second piece or said third piece such that said second piece corner and said third piece corner are aligned with each other, and wherein the first piece includes a skirt, and wherein, when nested, the skirt faces down on ground level, the one of the second and third pieces is slid in a first direction to surround the basin and abut against a back of the skirt, and the other of the second and third pieces is slid to completely surround and abut against the one of the second and third pieces.

2. The surround of claim 1 wherein said one of said second piece or said third piece is disposed under said basin and said other of said second piece or said third piece nests behind said one of said second piece or said third piece.

3. The surround of claim 1 wherein said one of said second piece or said third piece is disposed around said basin and said other of said second piece or said third piece nests behind said one of said second piece or said third piece.

4. The surround of claim 1 further comprising:

nesting shelving units.

5. The surround of claim 1 further comprising:

a seal disposed between said first and second pieces.

6. The surround of claim 5 wherein a top surface of said first piece is ramped downwardly from back to front whereby water may drain therefrom into said surround.

7. The surround of claim 6 wherein said top surface is ramped at greater than a 2° angle.

8. The surround of claim 1 further comprising:

a ledge disposed about a top of said basin.

9. The surround of claim 1 further comprising a skirt disposed at a front piece of said basin.

10. The surround of claim 1 wherein said second piece and said third piece each have an additional side piece attaching to said back piece to form a U-shape.

11. The surround of claim 1 further comprising:

an alignment feature between one of said first, second, and third pieces and an adjacent piece of another of said first, second, and third pieces.

12. The surround of claim 11 wherein said alignment feature includes a projection and a recess in which said projection is received in said adjacent piece for aligning said one piece and said adjacent piece.

13. The surround of claim 12 wherein said projection is a pin and wherein said recess is a hole.

14. The surround of claim 1 wherein one of said first piece or said second piece has a flange extending upwardly therefrom to attach said first piece or said second piece to a wall and to create a dam to prevent water from migrating behind said first piece or said second piece.

15. The surround of claim 14 wherein said flange attaches said first piece to said second piece during manufacture of said surround.

16. The surround of claim 14 wherein said flange extends from a top of said first piece or said second piece and a ratio between a length of said flange and a width of said top is not greater than 2:1.

17. The surround of claim 1 wherein said second piece and said third piece have a narrowing trapezoidal shape to aid nesting of the second and third piece with each other.

18. The surround of claim 1 wherein one of said second piece or said third piece is smaller than another of said second or third piece to enable nesting of said other piece behind said smaller piece via said second and third piece corners.

19. The surround of claim 1 further comprising a slippery layer disposed between the first and second or second and third pieces to enable a user to remove any of said first, second or third pieces from a box.

20. The surround of claim 1 further comprising a flange extending upwardly from each of said first piece and said second piece to minimize water leakage between said first piece and said second piece and between said second piece and said third piece.

21. The surround of claim 20 wherein said flange extends upwardly from said first piece and is disposed behind said second piece.

22. The surround of claim 1 wherein said second piece and said third piece have mating decorative portions.

23. The surround of claim 1 wherein said second piece and said third piece have mating decorative portions if one of said second piece is flipped relative to said third piece.

24. The surround of claim 1 wherein one or more of said second piece or said third piece are separated vertically.

25. The surround of claim 24 wherein one or more of said second piece and said third piece have a vertical depression disposed therebetween for separating said one or more of said second piece and said third piece wherein a section of said depression is disposed behind another of said second piece or said third piece upon separation of the pieces.

26. The surround of claim 1 wherein one or more of said first piece, said second piece or said third piece are separated horizontally.

27. The surround of claim 26 further comprising:

one or more of said first piece, said second piece and said third piece have a horizontal depression disposed therebetween for separating said one or more of said first piece, said second piece and said third piece wherein a section of said depression is disposed behind another of said second piece or said third piece upon separation of the pieces.

28. A surround, the surround comprising:

a first piece including a basin, a second piece having a second piece back wall and a second piece side wall attaching to said second piece back wall at a second piece corner, said second piece configured to be disposed horizontally atop said first piece, a third piece having a third piece back wall and a third piece side wall attaching to said third piece back wall at a third piece corner, said third piece configured to be disposed horizontally atop said second piece, a package to receive said first, second, and third pieces for shipping, wherein one of said second and third piece is disposed about said basin and the other of said second and third piece is disposed about said one of said second and third piece such that said second and third piece corners are nested relative to each other in an overlapping relationship to form a nested assembly that is enclosed within the package, and wherein the second piece corner of the second piece comprises a pushed-in corner defined by a first dimension, and wherein the third piece corner of the third piece comprises a pushed-in corner defined by a second dimension different than the first dimension such that the pushed-in corners of the second and third pieces are completely nested relative to each other to form the nested assembly.

29. The surround of claim 28 wherein said first piece has a top and said second piece fits under said top.

30. The surround of claim 28 further comprising:

an accessory disposed in said package.

31. The surround of claim 28 further comprising:

a slippery layer disposed between one or more of the first, second or third pieces to enable a user to remove said first, second, or third pieces from said package.

32. The surround of claim 28 further comprising a flange extending upwardly from each of said first piece and said second piece to minimize water leakage between said first piece and said second piece and between said second piece and said third piece.

33. The surround of claim 28 wherein said flange extending upwardly from said first piece is disposed behind said second piece.

34. The surround of claim 28 wherein said second piece and said third piece have mating decorative portions.

35. The surround of claim 28 wherein said second piece and said third piece have mating decorative portions if one of said second and third pieces is flipped relative to said other of said second and third pieces.

36. The surround of claim 28 wherein said second and third pieces are separated vertically.

37. The surround of claim 36 wherein said second and third pieces include a vertical depression disposed therebetween for separating said second and third pieces, and wherein a section of said depression is disposed behind another of said second piece upon separation of the pieces.

38. The surround of claim 28 wherein said first piece and said second and third pieces are separated horizontally.

39. The surround of claim 38 further comprising:

a depression disposed between one or more second piece and said first piece, said one or more second piece and said first piece having a horizontal depression disposed therebetween for separating said one or more second piece, said first piece wherein a section of said depression is disposed behind another of said second piece upon separation of the one or more second pieces.

40. The surround of claim 28 wherein a user may choose between a plurality of second pieces.

41. The surround of claim 28 wherein a user may choose between a plurality of first pieces.

42. The surround of claim 28 wherein said second piece may include an accessory.

43. The surround of claim 28 wherein said second piece may include a decorative portion.

44. The surround of claim 28 wherein said second piece and said basin form a roughly rectangular package.

45. The surround of claim 28 wherein said second piece and said basin form a roughly triangular package.

46. The surround of claim 28 wherein said first piece is disposed on an edge thereof.

47. The surround of claim 28 wherein said first piece is disposed between side edges of said second piece, and one of said second and third pieces is nested within the other of said second and third pieces to form a triangular package.

48. The surround of claim 28 wherein said second piece has a u-shape and third piece is separated vertically to form a first segment and a second segment.

49. The surround of claim 48 wherein said first segment overlaps said second segment.

50. The surround of claim 49 wherein said first segment does not overlap said second segment.

51. The surround of claim 28 wherein said second piece is separated into one or more vertical segments.

52. The surround of claim 51 wherein said segments are stacked about said basin for shipping.

53. The surround of claim 1 wherein the second and third pieces are slidable into abutment with each other when nested to form a nested assembly.

54. The surround of claim 1 wherein the one of said second piece or said third piece is in abutment with said first piece when nested to form a nested assembly.

55. The surround of claim 1 wherein the second piece side wall and second piece back wall are angled inwardly toward the basin, and wherein the third piece side wall and third piece back wall are angled inwardly toward the basin such that when assembled the second and third pieces form a trapezoidal shape having a greatest dimension at an uppermost portion of the third piece and a smallest dimension at the basin.

56. The surround of claim 1 wherein the first direction comprises a horizontal direction relative to ground level and wherein the one of the second and third pieces is slid in the horizontal direction such that the back wall faces a bottom of the basin, and the other of the second and third pieces is slid in the horizontal direction such that the back wall of the other of the second and third pieces completely overlaps the back wall of the one of the second and third pieces to form the nested assembly.

57. The surround of claim 1 wherein the first direction comprises a vertical direction relative to ground level and wherein the one of the second and third pieces is slid in the vertical direction such that the back wall faces a side of the basin, and wherein the other of the second and third pieces is slid in the vertical direction such that the back wall of the other of the second and third pieces completely overlaps the back wall of the one of the second and third pieces to form the nested assembly.

58. A surround, the surround comprising:

a first piece including a basin, a second piece having a second piece back wall and a second piece side wall attaching to said second piece back wall at a second piece corner, said second piece configured to be disposed horizontally atop said first piece, a third piece having a third piece back wall and a third piece side wall attaching to said third piece back wall at a third piece corner, said third piece configured to be disposed horizontally atop said second piece back wall and said second piece side wall, wherein said first piece, said second piece and said third piece form a package wherein one of said second piece or said third piece is disposed about said basin and another of said second piece or said third piece nests behind said one of said second piece or said third piece such that said second piece corner and said third piece corner are aligned with each other, and wherein the second piece corner of the second piece comprises a pushed-in corner defined by a first dimension, and wherein the third piece corner of the third piece comprises a pushed-in corner defined by a second dimension different than the first dimension such that the pushed-in corners of the second and third pieces are completely nested relative to each other to form the nested assembly.

59. The surround of claim 1 wherein the second piece includes at least one first shelf extending inwardly from one side to form a first recess in an opposite side, and wherein the third piece includes at least one second shelf extending inwardly from one side to form a second recess in an opposite side, and wherein one of the first and second shelves is nested within the other of the first and second shelves to form the nested assembly.

60. The surround of claim 28 wherein the second and third pieces are slidable into abutment with each other when nested to form a nested assembly.

61. The surround of claim 28 wherein the one of said second piece or said third piece is in abutment with said first piece when nested to form a nested assembly.

62. The surround of claim 28 wherein the second piece side wall and second piece back wall are angled inwardly toward the basin, and wherein the third piece side wall and third piece back wall are angled inwardly toward the basin such that when assembled the second and third pieces form a trapezoidal shape having a greatest dimension at an uppermost portion of the third piece and a smallest dimension at the basin.

63. A surround, the surround comprising:

a first piece including a basin, a second piece having a second piece back wall and a second piece side wall attaching to said second piece back wall at a second piece corner, said second piece configured to be disposed horizontally atop said first piece, a third piece having a third piece back wall and a third piece side wall attaching to said third piece back wall at a third piece corner, said third piece configured to be disposed horizontally atop said second piece, a package to receive said first, second, and third pieces for shipping, wherein one of said second and third piece is disposed about said basin and the other of said second and third piece is disposed about said one of said second and third piece such that said second and third piece corners are nested relative to each other in an overlapping relationship to form a nested assembly that is enclosed within the package, and wherein the first piece includes a skirt, and wherein, when nested, the skirt faces down on ground level, the one of the second and third pieces is slid in a first direction to surround the basin and abut against a back of the skirt, and the other of the second and third pieces is slid to completely surround and abut against the one of the second and third pieces.

64. The surround of claim 63 wherein the first direction comprises a horizontal direction relative to ground level and wherein the one of the second and third pieces is slid in the horizontal direction such that the back wall faces a bottom of the basin, and the other of the second and third pieces is slid in the horizontal direction such that the back wall of the other of the second and third pieces completely overlaps the back wall of the one of the second and third pieces to form the nested assembly.

65. The surround of claim 63 wherein the first direction comprises a vertical direction relative to ground level and wherein the one of the second and third pieces is slid in the vertical direction such that the back wall faces a side of the basin, and wherein the other of the second and third pieces is slid in the vertical direction such that the back wall of the other of the second and third pieces completely overlaps the back wall of the one of the second and third pieces to form the nested assembly.

66. The surround of claim 28 wherein the second piece includes at least one first shelf extending inwardly from one side to form a first recess in an opposite side, and wherein the third piece includes at least one second shelf extending inwardly from one side to form a second recess in an opposite side, and wherein one of the first and second shelves is nested within the other of the first and second shelves to form the nested assembly.

* * * * *